US006081197A

United States Patent [19]

Garrick et al.

[11] Patent Number: 6,081,197

[45] Date of Patent: Jun. 27, 2000

[54] FIRE DETECTOR SILENCEABLE LOW BATTERY PRE-ALARM

[76] Inventors: Gilbert Alain Lindsay Garrick; Marie Jeanette Corinne Garrick, both of 21, Cammeray Court, Central Park Phillip ACT 2606, Australia

[21] Appl. No.: 09/155,620

[22] PCT Filed: Apr. 4, 1997

[86] PCT No.: PCT/AU97/00218

§ 371 Date: Sep. 29, 1998

§ 102(e) Date: Sep. 29, 1998

[87] PCT Pub. No.: WO97/38406

PCT Pub. Date: Oct. 16, 1997

[30] Foreign Application Priority Data

Apr. 4, 1996 [AU] Australia ..... PN 9120

[51] Int. Cl.[7] ..... G08B 21/00

[52] U.S. Cl. ..... 340/636; 340/628; 320/114; 320/145; 320/164; 320/48; 320/75

[58] Field of Search ..... 340/636, 628; 320/114, 145, 164, 48, 75

[56] References Cited

U.S. PATENT DOCUMENTS

| | | | |
|---|---|---|---|
| 4,037,206 | 7/1977 | Dobrzanski et al. | 340/237 |
| 4,313,110 | 1/1982 | Subulak et al. | 340/527 |
| 4,318,092 | 3/1982 | Cowles et al. | 340/636 |
| 4,419,658 | 12/1983 | Jarosz et al. | 340/521 |
| 4,660,027 | 4/1987 | Davis | 340/636 |
| 5,053,752 | 10/1991 | Epstein et al. | 340/628 |
| 5,304,986 | 4/1994 | Motegi | 340/636 |
| 5,422,629 | 6/1995 | Minnis | 340/630 |
| 5,424,721 | 6/1995 | Asai | 340/636 |

*Primary Examiner*—Daniel J. Wu
*Assistant Examiner*—Tai T. Nguyen
*Attorney, Agent, or Firm*—Delbert R. Phillips; James L. Sonntag

[57] ABSTRACT

A method of monitoring the condition of the battery of a smoke or heat alarm so as to provide a warning of an impending low battery condition, said method including: means of providing a low battery alarm to warn of a low battery condition, the said condition being that of a battery which has depleted to an energy level at and below which it is recommended that the battery be replaced to maintain the full functionality of the alarm device; means of providing an additional low battery pre-alarm to warn of an impending low battery condition, the said low battery pre-alarm being provided when the smoke or heat alarm battery has depleted to an energy level which is slightly higher than, but close to, the energy level that would generate the low battery alarm, and means of bypassing or silencing the low battery pre-alarm, in the event of an impending low battery condition, should a new battery not be available to immediately replace the depleted smoke or heat alarm battery, with the result that the occupants of the protected premises have several hours or days to procure themselves of a new battery before the battery in use depletes further to reach the energy level at and below which the low battery alarm is generated.

10 Claims, 4 Drawing Sheets

FIRE DETECTOR SILENCEABLE LOW BATTERY PRE-ALARM

Figure 1:
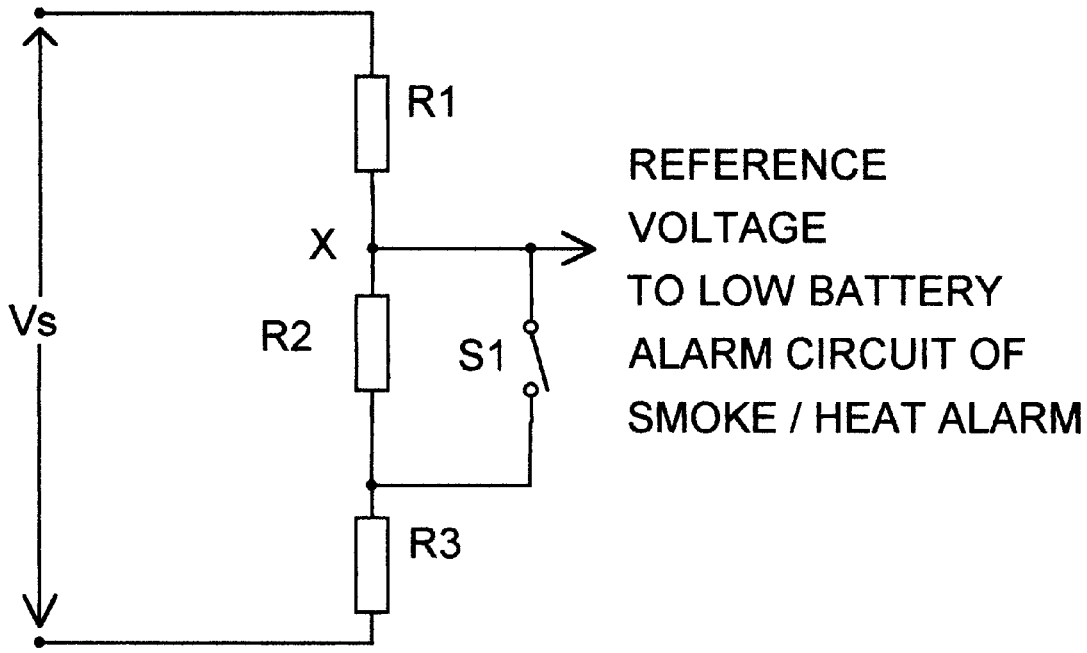

This invention relates to smoke and heat alarms as used in buildings to warn of a fire condition, and to methods of monitoring the energy levels of the batteries of these devices to provide a silenceable low battery pre-alarm warning in addition to the low battery warning emitted by smoke and heat alarms.

As used herein, the expression "low battery warning" or "low battery alarm" is to be taken as meaning the warning, visual and/or audible, emitted by a smoke or heat alarm when the battery of the alarm device has reached or exceeded the level of depletion at which the manufacturer recommends that the battery be replaced.

Similarly, as used herein, the expression "low battery pre-alarm" or "low battery pre-alarm warning" is to be taken as meaning the warning, visual and/or audible, emitted by a smoke or heat alarm when the battery of the alarm device has depleted to a level which is close to that required to generate a low battery warning.

It is also to be understood that during the battery discharge process, the energy level of the battery reaches that required to generate the low battery pre-alarm warning first. If the battery is allowed to discharge further after the low battery pre-alarm energy level has been reached, a lower battery energy level is reached at and beyond which the low battery alarm is emitted.

BACKGROUND

Smoke and heat alarms are extensively used in domestic dwellings, motels, hotels, hospitals, old people's homes, and in general commercial premises. Most of these devices incorporate internal batteries and are generally are of two main types, namely:

(1) single supply smoke and heat alarms powered only by their internal batteries and (2) dual supply smoke and heat alarms where the alarm devices are powered by an external primary power supply with internal batteries as the standby power source.

It is a characteristic of the above mentioned two types of smoke and heat alarms that at regular intervals, normally not exceeding 60 seconds, the alarm device enters into a self-test mode when a current which is much higher than the quiescent current is briefly drawn from the smoke or heat alarm battery. The electronic circuitry of the alarm device then detects whether the battery voltage in self-test mode is above a certain threshold value. If the battery voltage is detected to be below the low battery voltage threshold value, normally around seven and a half volts, the alarm device activates an internal circuit to produce an audible warning indicating a low or depleted battery requiring replacement. For safety reasons, currently manufactured smoke or heat alarms do not have provisions for the low battery warning to be silenced.

Although the low battery warning is an important safety feature of the smoke and heat alarms described above, as the warning cannot be silenced, a situation very often arises where the low battery audible warning causes major difficulties/disadvantages as exemplified below:

(1) If no replacement battery is available at the time when the smoke or heat alarm starts emitting the low battery warning, occupants of the protected premises have to endure the inconvenience of the audible warning until such time as they procure themselves of a new battery and carry out the battery replacement. The audible warning is particularly inconvenient if the alarm device is installed in a bedroom and starts to emit the low battery audible warning signal in the middle of the night with the result that the occupants of the bedroom, or any other bedroom in the area, cannot go back to sleep.

(2) It is known that often occupants, of dwellings particularly, resort to drastic unsafe practices in order to eliminate the inconvenience of the low battery warning until such time as a replacement battery is available. These unsafe practices are:

(a) the complete removal or disconnection of internal batteries of single supply smoke and heat alarms, and (b) the disconnection/turning off of both the primary and standby power sources of dual supply smoke and heat alarms.

Both the above practices may result in potentially dangerous situations where the fire detection and warning functions of the alarm devices are lost.

It is the object of the present invention to provide a new facility to smoke and heat alarms which overcomes the above difficulties/disadvantages without affecting the functionality and the operation of these alarm devices, including the operation of the low battery warning function currently available.

According to the present invention, and in addition to the smoke and heat alarm low battery warning, a low battery pre-alarm warning is provided, which can be silenced, and which operates at a threshold voltage of value slightly higher than the smoke or heat alarm low battery threshold voltage, the operation of the low battery pre-alarm warning being characterised in that:

(1) as the smoke or heat alarm battery voltage under self-test mode approaches the low battery threshold voltage of the alarm device, a battery voltage is reached when the low battery pre-alarm warning is provided. The low battery pre-alarm warning may then be silenced if a replacement battery is not immediately available, with the result that (2) the occupants of the protected premises receive prior warning, several hours or days in advance, of an impending low battery condition. During this time the occupants can procure themselves of a new battery to replace the one in use without having to resort to the unsafe practices of battery removal or disconnection/turning off of power supplies, or suffer the inconvenience of an ongoing audible warning being emitted. The low battery pre-alarm voltage threshold value is normally a few tenths of a volt higher than the low battery voltage threshold value of the smoke or heat alarm.

Also according to this invention, should the occupants of the protected premises decide to silence the low battery pre-alarm warning because a new battery is not immediately available, and then they fail to replace the battery in use, a point is reached when the battery is further depleted so that its voltage in self-test mode falls further and reaches the low battery voltage threshold value of the alarm device. The latter then resumes the emission of a warning to indicate and warn of a low battery condition. For safety reason, this warning cannot be silenced.

Embodiments of the invention are described in the following subsections of this specification and are as illustrated by the accompanying drawings. The drawings, however, are merely illustrative of how the invention might be put into effect and are not to be understood as being limiting on the invention.

First Embodiment—Using Dual Low Battery Threshold Settings

In this embodiment, it is possible to select one of two threshold voltage reference values, one for low battery alarm and the other for low battery pre-alarm, through the simple operation of a switch as shown in FIG. 1. The low battery reference voltage is normally around seven and a half volts whereas the low battery pre-alarm has a reference voltage which is marginally higher.

Referring to FIG. 1, resistors R1, R2, and R3 are connected in series across a stabilised voltage Vs, derived from the smoke or heat alarm power source, with switch S1 connected across resistor R2. The reference voltage at point X is applied to the low battery warning circuit of the alarm device, the function of the circuit being to compare the voltage of the battery, under battery test conditions, to the reference voltage at point X. It should be noted that, as resistors R1, R2, and R3 are all in series across the stabilised supply Vs, the reference voltage at point X is higher when switch S1 is open. The voltage at point X then corresponds to the low battery pre-alarm reference voltage. Similarly, the closure of switch S1 causes the reference voltage at point X to drop slightly, through the bypassing of resistor R2, to provide the low battery alarm reference voltage.

Switch S1 is normally held open resulting in the low battery pre-alarm reference voltage being applied to the low battery alarm circuit of the smoke or heat alarm. In this condition, should the low battery warning circuit operate because of depletion of the battery over time, the low battery pre-alarm warning can be silenced, if required, by closing switch S1. Closure of switch S1 effectively changes the low battery pre-alarm reference voltage at point X to a lower reference voltage value corresponding to the low battery alarm, with the result that the occupants of the protected premises then have several hours or days, depending on the relative values of R1, R2, and R3, to carry out the battery replacement before further depletion of the battery takes place to cause the battery voltage under test mode to drop to the low battery alarm reference voltage. The alarm device then resumes the emission of the audible warning which, for safety reason, cannot be silenced.

Second Embodiment—Using Series Voltage Drop Method

With the first embodiment, some connections to the smoke or heat alarm printed circuit board are necessary to provide the low battery pre-alarm facility. Thus, it may be difficult for manufacturers to incorporate the additional components onto the smoke/heat alarm printed circuit board to provide the new facility. Furthermore, modifications of smoke or heat alarms manufactured to current designs are difficult and are certainly beyond the capabilities of most owners of existing smoke and heat alarms. The second embodiment provides solutions to both the above problems.

Figure 2:
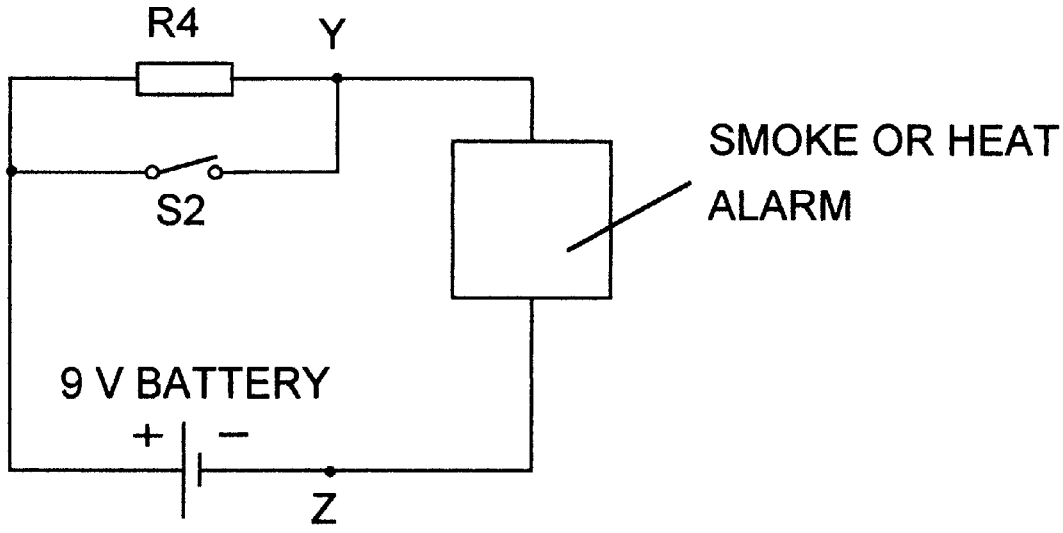

According to this invention, and as put into effect by the second embodiment, a resistor R4 is connected in series with the smoke or heat alarm battery supply. Resistor R4 has a switch S2 connected in parallel with it which, when closed, bypasses and cancels the effect of R4. The circuit diagram for the second embodiment is as shown in FIG. 2 and the operation is as follows:

(1) Under normal quiescent conditions, with switch S2 open, the smoke or heat alarm current is of the order of a few microamps so that the voltage drop across R4 is negligible and, for all intents and purposes, can be ignored.

(2) Resistor R4 is calculated so that, under battery test conditions, the voltage drop across R4 is of the order of a few tenths of a volt when switch S2 is open.

(3) With switch S2 open, it is to be noted that under battery test conditions, the voltage applied to the smoke or heat alarm, between points Y and Z, is less than the battery voltage by a few tenths of a volt due to voltage drop across resistor R4. Therefore, due to the effect of R4, with S2 open, the low battery warning circuit of the smoke or heat alarm operates when the voltage of the battery under test drops to a value equal to the sum of the low battery threshold voltage and the voltage drop across R4. Thus the low battery pre-alarm warning is achieved which can be silenced by closing switch S2. The closure of switch S2 has the same effect as closing the switch S1 of the previous embodiment, with the result that the occupants of the protected premises receive prior warning of an impending low battery condition, warning which can be silenced should a new battery not be immediately available.

The advantage of the second embodiment is that the parallel combination of R4 and S2 is in series with the battery supply and can easily be mounted external to the smoke or heat alarm printed circuit board which therefore does not require any modification. The connection to the smoke or heat alarm is then made through the battery leads or connectors. The second embodiment is further exemplified by FIGS. 3, 4, & 5.

Figure 3:
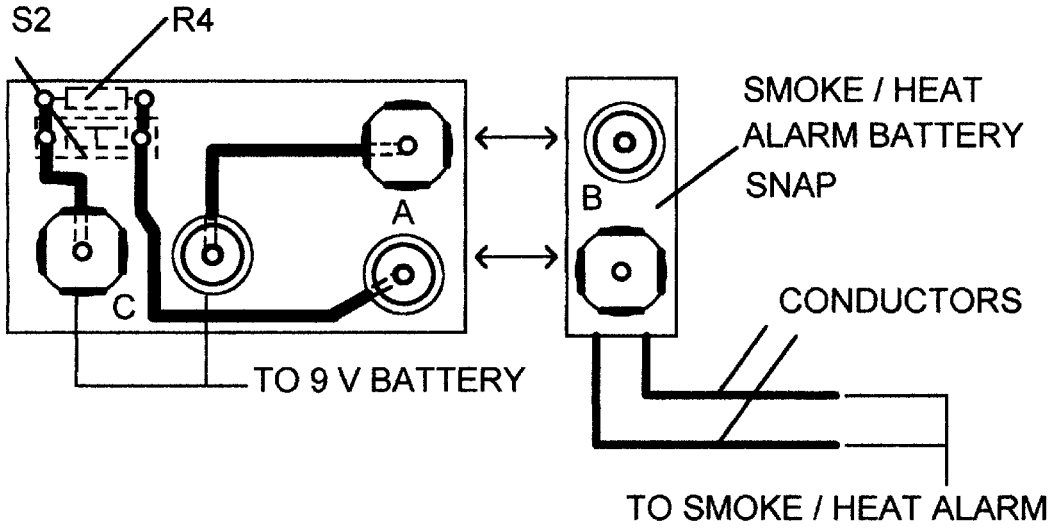

FIG. 3 describes how the battery snap or connectors B of the smoke or heat alarm may be connected to the battery of the alarm device through a printed circuit board incorporating 2 sets, A and C, of battery connectors, the said printed circuit board also including resistor R4 and switch S2 of the second embodiment. Set C of battery connectors is used for connection of the battery, while set A of battery connectors is used for connecting the printed circuit board to the existing set B of battery connectors of the smoke/heat alarm. Therefore, this form of the invention is particularly suited for retrofitting alarm devices manufactured to current design.

Figure 4:
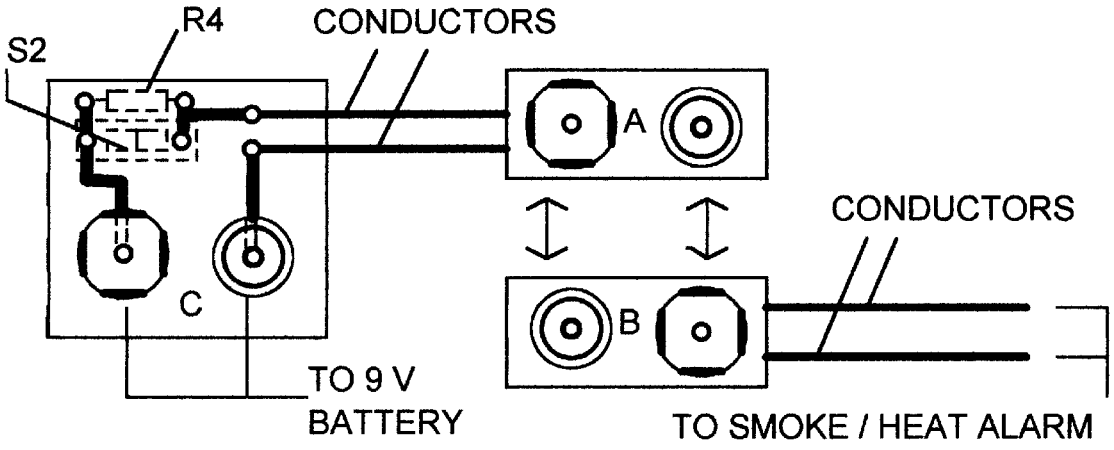

FIG. 4 is essentially the same as FIG. 3 except that the printed circuit board is smaller because of the exclusion of set A of battery connectors which are now on a separate battery snap wired to the printed circuit board through two conductors. This form of the invention is also suitable for retrofitting alarm devices manufactured to current design.

Figure 5:
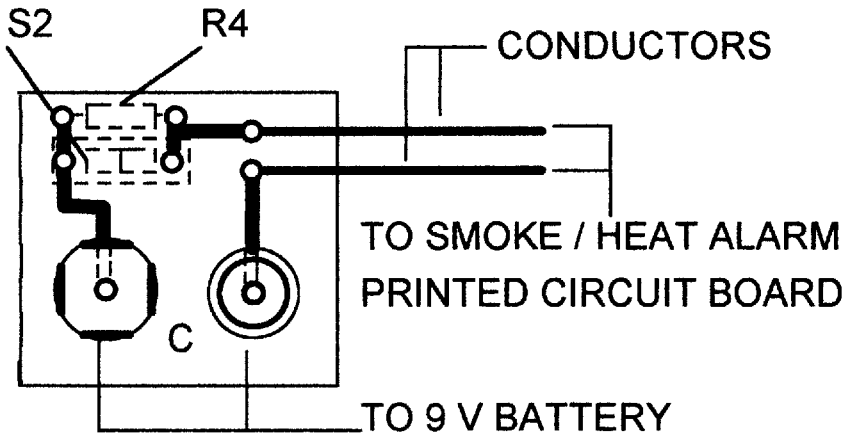

FIG. 5 is similar to FIG. 4 with the exception that the printed circuit board incorporating set C of battery connectors is connected to the smoke or heat alarm through separate conductors which are terminated/soldered to the smoke or heat alarm printed circuit board. This form of the invention is particularly suitable for new smoke/heat alarms as the provision of the low battery pre-alarm facility only involves the change of the normal battery connectors and leads to the circuit board and leads arrangement of FIG. 5.

It may sometimes be preferable to eliminate the additional switch and printed circuit board of the second embodiment because of space constraints and limitations. In this case, the switching action to bypass the series voltage dropping resistor for silencing the low battery pre-alarm facility is carried out as follows.

Figure 6:
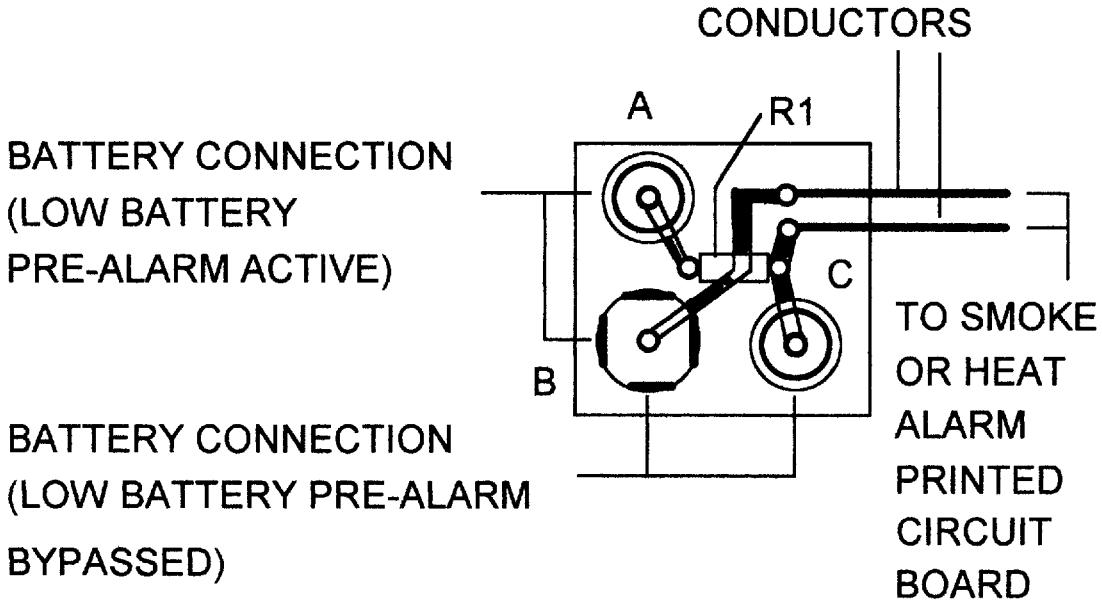

Referring to FIG. 6, connection to the smoke/heat alarm battery is through a specially designed arrangement of battery connectors A, B, and C, so that the spacing between A and B is equal to that between B and C. As the series voltage dropping resistor R1 is connected between connectors A and C, and since the leads/conductors used for connection to the smoke/heat alarm are connected to connectors B and C, it can be seen that by connecting the battery to connectors A and B, resistor R1 is effectively connected in series with the battery supply and the pre-alarm facility is active. If it is required to silence the low battery pre-alarm facility, resistor R1 is bypassed by making the connection to the battery through connectors B and C instead of through connectors A and B. In this position, resistor R1 is disconnected and bypassed to make the low battery pre-alarm facility inactive.

Although the first and second embodiments provide the advantages of the low battery pre-alarm facility, in both embodiments the actual silencing of the low battery pre-alarm facility, should it be required, is a manual function carried out by an occupant of the protected premises. In the case where the occupant is a permanent resident of the premises, this in practice is quite acceptable as the occupant is normally the one responsible for the maintenance and testing of the smoke/heat alarms. However, if the occupant is only a temporary resident of the premises, as in the case of motel and hotel residents, it is far more advantageous if the low battery pre-alarm facility could be used without any involvement on the part of the occupant.

The third and fourth embodiments, described in the two following subsections, are examples of how the invention can be put into effect to achieve this aim.

Third Embodiment—Using Dual Low Battery Threshold Settings to Provide the Low Battery Pre-Alarm Facility Which is Activated Automatically, and For a Fixed Duration Only, Each Time the Smoke/Heat Alarm is Tested Another form of the invention resides in the modification of the first embodiment, as described above, so that the low battery pre-alarm facility is only activated for a pre-determined period of time, say 10 minutes, each time the smoke/heat alarm is tested. As smoke/heat alarms are normally tested weekly, the low battery pre-alarm warning will then be emitted for a period of ten minutes immediately following the test should a low battery condition be impending. The advantage with this embodiment is that, as in the case of motels and hotels, each time the smoke/heat alarm is tested, the maintenance personnel carrying the test are immediately warned, in the pre-determined period following the test when the pre-alarm facility is active, should a low battery condition be impending. Therefore, battery replacement can be carried out immediately by the maintenance personnel ahead of a low battery warning being emitted.

Figure 7:
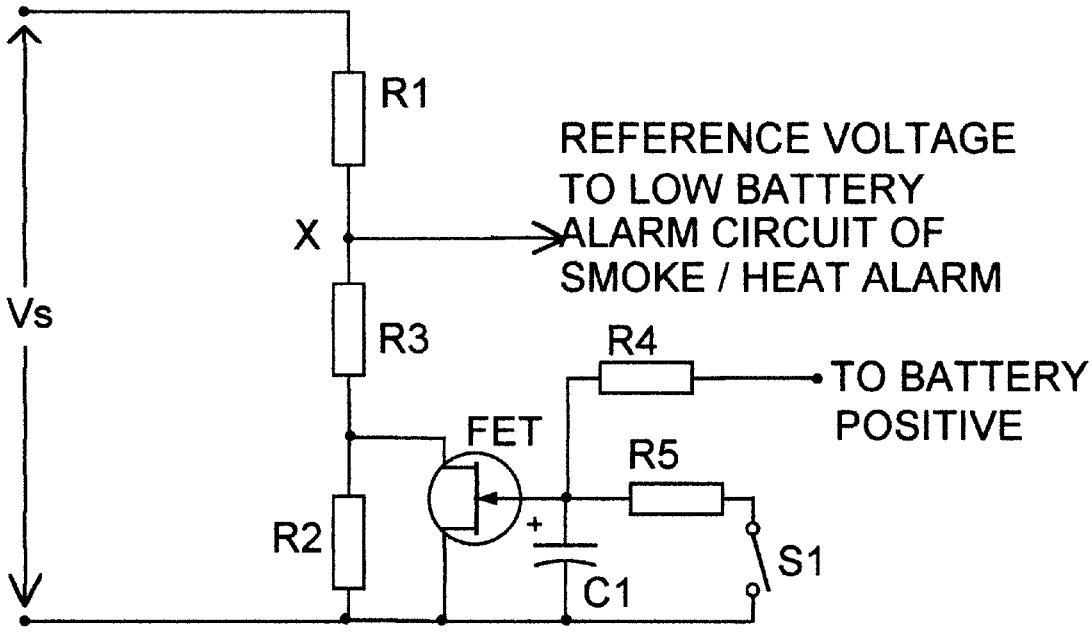

By designing the pre-alarm circuit to provide the low battery pre-alarm warning say two weeks in advance of the low battery warning being emitted, with normal quiescent smoke/heat alarm current being delivered by the battery, and since the pre-alarm facility is activated weekly as the alarm device is tested, it may be seen that the temporary residents of the motel/hotel will never have to suffer the inconvenience of a recurring low battery warning as the battery would have been changed before depleting to a level which would activate the low battery warning. The description of the third embodiment is as follows:

Referring to FIG. 7, capacitor C1 is kept charged by resistor R4 connected to the battery positive terminal. Therefore, under normal conditions the FET transistor conducts to effectively bypass resistor R2 resulting in the low battery pre-alarm facility being de-activated. When the smoke or heat alarm is tested, S1 is closed, as it is ganged to the test switch, to discharge capacitor C1. Thus the FET transistor no longer conducts and the pre-alarm facility is activated for a pre-determined period which depends on the values of components R4 and C1. After the pre-determined period, the capacitor C1 has acquired enough charge to cause the FET transistor to conduct again when the pre-alarm facility is deactivated. During the period of time when the pre-alarm facility is activated, the smoke or heat alarm will emit a warning should a low battery condition be impending.

Fourth Embodiment—Using the Series Voltage Drop Method to Provide the Low Battery Pre-Alarm Facility Which is Activated Automatically, and For a Fixed Duration Only, Each Time the Smoke/Heat Alarm is Tested The second embodiment can be modified to provide features identical to those of the third embodiment in the following manner.

Figure 8:
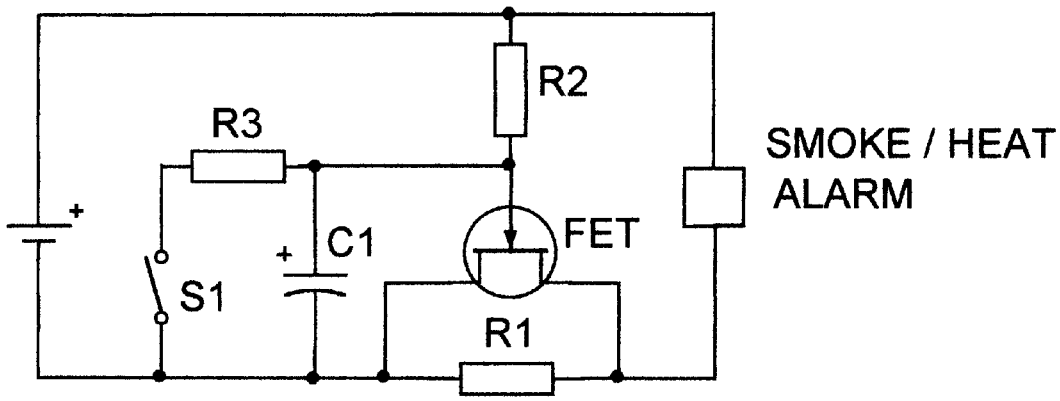

Referring to FIG. 8, capacitor C1 is kept charged by resistor R2 connected to the battery positive terminal. Therefore, under normal conditions the FET transistor conducts to effectively bypass resistor R1 resulting in the low battery pre-alarm facility being de-activated. When the smoke or heat alarm is tested, S1 is closed, as it is ganged to the test switch, to discharge capacitor C1. Thus the FET transistor no longer conducts and the pre-alarm facility is activated for a pre-determined period which depends on the values of components R2 and C1. After the pre-determined period, the capacitor C1 has acquired enough charge to cause the FET transistor to conduct again when the pre-alarm facility is deactivated. During the period of time when the pre-alarm facility is activated, the smoke or heat alarm will emit a warning should a low battery condition be impending.

We claim:

1. A method of monitoring the condition of the battery of a smoke or heat alarm so as to provide a warning of an impending low battery condition, said method comprising:

providing a low battery alarm to warn of a low battery condition, the said condition being that of a battery which has depleted to an energy level at and below which it is recommended that the battery be replaced to maintain the full functionality of the alarm device;

providing an additional low battery pre-alarm to warn of an impending low battery condition, the said low battery pre-alarm being provided when the smoke or heat alarm battery has depleted to an energy level which is slightly higher than, but close to, the energy level that would generate the low battery alarm, and bypassing or silencing the low battery pre-alarm without disabling the low battery alarm, in the event of an impending low battery condition, should a new battery not be available to immediately replace the depleted smoke or heat alarm battery, with the result that the occupants of the protected premises have several hours or days to procure themselves of a new battery before the battery in use depletes further to reach the energy level at and below which the low battery alarm is generated.

2. A method as claimed in claim 1 wherein the bypassing or silencing of the low battery pre-alarm is carried out manually.

3. A method as claimed in claim 1, wherein the low battery pre-alarm facility only operates to warn of an impending low battery condition after it has been activated.

4. A method as claimed in claim 1, wherein the low battery pre-alarm facility only operates to warn of an impending low battery condition for a pre-determined period of time after it has been activated.

5. A method as claimed in claim 3, wherein the low battery pre-alarm facility is activated manually.

6. An apparatus for monitoring the condition of the battery of a smoke or heat alarm so as to provide a warning of an impending low battery condition, said apparatus comprises:

a low battery alarm said low battery alarm generating a warning of a low battery condition when the battery voltage drops below a first predetermined voltage;

a low battery pre-alarm;

said additional low battery pre-alarm generating a warning of an impending low battery condition when the voltage drops to a second pre determined voltage slightly higher that the first pre determined voltage;

and a switching means for bypassing or silencing said low battery pre-alarm without disabling the low battery alarm.

7. An apparatus as claimed in claim 6, wherein said switching means is a manual switch.

8. An apparatus as claimed in 6, wherein said low battery pre-alarm only operates to generate the warning of an impending low battery condition for a predetermined period of time after it has been activated.

9. A method of monitoring the condition of the battery of a smoke or heat alarm so as to provide a warning of an impending low battery condition, said method comprising:

providing a low battery alarm to warn of a low battery condition, the said condition being that of a battery which has depleted to an energy level at and below which it is recommended that the battery be replaced to maintain the full functionality of the alarm device;

providing an additional low battery pre-alarm to warn of an impending low battery condition, the said low battery pre-alarm being provided when the smoke or heat alarm battery has depleted to an energy level which is slightly higher than, but close to, the energy level that would generate the low battery alarm, and said low battery pre-alarm being provided to generate the warning of the impending low battery condition for a predetermined period of time after it has been activated automatically when the smoke or heat alarm is tested, and bypassing or silencing the low battery pre-alarm without disabling the low battery alarm, in the event of an impending low battery condition, should a new battery not be available to immediately replace the depleted smoke or heat alarm battery, with the result that the occupants of the protected premises have several hours or days to procure themselves of a new battery before the battery in use depletes further to reach the energy level at and below which the low battery alarm is generated.

10. An apparatus for monitoring the condition of the battery of a smoke or heat alarm so as to provide a warning of an impending low battery condition, said apparatus comprises:

a low battery alarm said low battery alarm generating a warning of a low battery condition when the battery voltage drops below a first predetermined voltage;

a low battery pre-alarm;

said additional low battery pre-alarm generating a warning of impending low battery condition when the voltage drops to a second pre determined voltage slightly higher that the first pre determined voltage, said additional low battery pre-alarm generating a warning of impending low battery condition for a predetermined time after the smoke or heat alarm is tested;

and a switching means for bypassing or silencing said low battery pre-alarm without disabling the low battery alarm.

* * * * *